US006978492B1

(12) United States Patent
Francisco

(10) Patent No.: US 6,978,492 B1
(45) Date of Patent: Dec. 27, 2005

(54) PERSONAL HYGIENE TOILET KIT

(76) Inventor: Felix V. Francisco, deceased, late of Moreno Valley, CA (US); by Gloria Francisco, legal representative, 15530 Ocana La., Moreno Valley, CA (US) 92551

( * ) Notice: Subject to any disclaimer, the term of this patent is extended or adjusted under 35 U.S.C. 154(b) by 0 days.

(21) Appl. No.: 11/116,606

(22) Filed: Jul. 20, 2005

(51) Int. Cl.[7] ..... A47K 3/20
(52) U.S. Cl. ..... 4/420.4; 4/448; 4/443
(58) Field of Search ..... 4/420.1, 420.2, 4/420.4, 420.5, 443, 445, 448

(56) References Cited

U.S. PATENT DOCUMENTS 3,662,407 A * 5/1972 Colucci ..... 4/420.2
5,809,585 A 9/1998 Farshad
5,987,659 A * 11/1999 Cannizzaro ..... 4/420.2
5,991,937 A * 11/1999 Safara ..... 4/420.2
6,357,057 B1 * 3/2002 Krist ..... 4/420.4
6,473,913 B1 * 11/2002 Bell, Sr. ..... 4/448
6,941,590 B2 * 9/2005 Lim ..... 4/420.4

* cited by examiner

*Primary Examiner*—Justine R. Yu
*Assistant Examiner*—Huyen Le
(74) *Attorney, Agent, or Firm*—Mark Ashley Crossley; Crossley Patent Law

(57) ABSTRACT

A complete personal hygiene toilet kit which also provides for use in cleansing a toilet, the kit comprised of a double connect for connecting to an existing toilet water supply, a flow and pressure control valve supplying a flex hose with sprayer, the holster for the sprayer which prevents inadvertent dislodgement of the sprayer, a disposable glove bag with gloves removably adhering to a wall. Spray adjustments and controls provide for pressure and flow control such that the invention gently cleanses a user but firmly sprays for cleansing a toilet or surrounding areas.

9 Claims, 3 Drawing Sheets

PERSONAL HYGIENE TOILET KIT

BACKGROUND OF THE INVENTION

Modern bathrooms typically contain a disposal toilet that utilizes a reservoir containing water to wash urine, excrement, and the like down a bowl of the toilet and into a sewer drain below. Bidet systems are also known in the art. Bidets provide the advantage of allowing personal cleansing with fresh water. Bidets, however, typically require a separate toilet like device. The present invention provides the advantages of a bidet coupled with the typical toilet, thereby saving space and expense. The present invention provides all needs for personal hygiene after toileting in a kit apparatus. The device also provides for water pressure and flow adjustment such that the apparatus is used for cleaning the toilet also. An additional problem overcome by the invention is one of inadvertent spray of water, without sacrificing the ready-to-use condition in which the invention is maintained.

FIELD OF THE INVENTION

The invention relates to bidets and to toilet cleaning devices, and more specifically to a complete personal hygiene toilet kit which also provides for use in cleansing a toilet.

SUMMARY OF THE INVENTION

The general purpose of the personal hygiene toilet kit, described subsequently in greater detail, is to provide a personal hygiene toilet kit which has many novel features that result in an improved personal hygiene toilet kit which is not anticipated, rendered obvious, suggested, or even implied by prior art, either alone or in combination thereof.

To accomplish this, the invention comprises a valved double connect. The valved double connect is removably attached to an existing water supply. The valved double connect employs a knurled knob to connect to the existing water supply. The double connect, on one end, supplies the existing reservoir supply of the typical toilet. The second end of the double connect supplies water to the flex hose. The supply to the flex hose is regulated by the control valve. The control valve is adjusted by the adjustment knob. The control valve is disposed at a right angle to the body of the double connect. The hose connect connects the flex hose to the control valve. The flex hose supplies the sprayer of typical design known in the art. The sprayer is temporarily positioned over the toilet.

The sprayer is further comprised of the sprayer body and the spray head. Flow through the spray head is regulated by the trigger. The shape of the sprayer is generally that of a pistol. The invention is further comprised of a holster for removably containing the sprayer. The holster is generally an inverted L-shape and mounts to a wall within a typical bathroom.

The holster inverted L-shape comprises back plate. The back plate comprises at least two mounting holes, one hole above the other. Mounting holes would preferably be aligned with a wall stud. The sprayer retainer is perpendicularly affixed to the side of the back plate. The retainer further comprises a retainer bend. The retainer bend is affixed to the retainer at a right angle to the retainer. The retainer bend is coplanar to the back plate. The spray head rest is perpendicularly affixed to the back plate. The spray head rest is of a like but smaller L-shape as the back plate. The spray head rest is on a side of the back plate opposite the retainer. The spray head rest is perpendicularly affixed to the back plate. The keeper is affixed at a right angle to the spray head rest. The keeper is coplanar to the back plate. The keeper and the retainer bend are at a spaced apart distance on the back plate. The trunk is formed by the spaced apart placement of the sprayer retainer and the spray head rest. The sprayer thereby removably and securely rests within the holster. The trunk provides for removal of the sprayer from the holster. The sprayer is lifted from the rest. The flex hose passes out of the trunk. The holster prevents the sprayer from falling out and inadvertently spraying water. The type of sprayer used is known in the art and is capable of spraying a significant amount of water.

A dislodged sprayer can also be triggered and retained in an open position, thereby flowing an even more significant amount of water. Correctly holding the sprayer is a therefore a critical element to proper operational control of the kit.

An alternate example of the double connect is comprised of an inlet. The inlet is supplied by the existing water supply for a typical toilet. The bi-directional flow channel is supplied by the inlet at a right angle. A male thread is on one end of the valved double connect. The male thread removably receives the existing reservoir supply to the toilet. A like second male thread is on the opposite end of the double connect. The valve ramp is disposed in the flow channel. The ramp is disposed between the inlet and the second male thread. The push valve is disposed between the inlet and the second male thread. The push valve is adjacent to the ramp. The push valve comprises a rigid side. The rigid side is disposed on one side of the flow channel. The piston bore extends across the flow channel. The piston bore is in coplanar alignment to the rigid side of the push valve. The bore perpendicularly opens to the flow channel. The control piston adjustably moves within the bore by adjustment means. The rigid side and the piston are sealed within the double connect by o-rings. The push valve thereby controls water through the double connect.

The kit further comprises a glove bag holding disposable gloves. The glove bag is removably affixed to a wall by a double sided adhesive. The gloves are used in operating the sprayer such that any effluent and water does not contaminate a user's hand.

The flow control and pressure control to the flex hose and thence the sprayer provide for the invention to have significant pressure and flow adjustment, therefore what is termed as graduated flow. The flow and pressure are adjusted to provide for gentle flow in personal hygiene use. And, the pressure and flow adjustment provide for greater pressure and flow for cleansing the toilet itself or even surrounding areas of the bathroom in need of cleansing. The kit is complete and versatile.

Thus has been broadly outlined the more important features of the personal hygiene toilet kit so that the detailed description thereof that follows may be better understood and in order that the present contribution to the art may be better appreciated.

Numerous objects, features and advantages of the personal hygiene toilet kit will be readily apparent to those of ordinary skill in the art upon reading the following detailed description of presently preferred, but nonetheless illustrative, examples of the personal hygiene toilet kit when taken in conjunction with the accompanying drawings. In this respect, before explaining the current examples of the personal hygiene toilet kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the personal hygiene toilet kit. It is therefore important that the claims be regarded as including such equivalent constructions insofar as they do not depart from the spirit and scope of the present invention.

Objects of the personal hygiene toilet kit, along with various novel features that characterize the invention are particularly pointed out in the claims forming a part of this disclosure. For better understanding of the personal hygiene toilet kit, its operating advantages and specific objects attained by its uses, refer to the accompanying drawings and description.

DETAILED DESCRIPTION OF THE DRAWINGS

With reference now to the drawings, and in particular FIGS. 1 through 6 thereof, example of the personal hygiene toilet kit employing the principles and concepts of the present invention and generally designated by the reference number 10 will be described.

Figure 1:
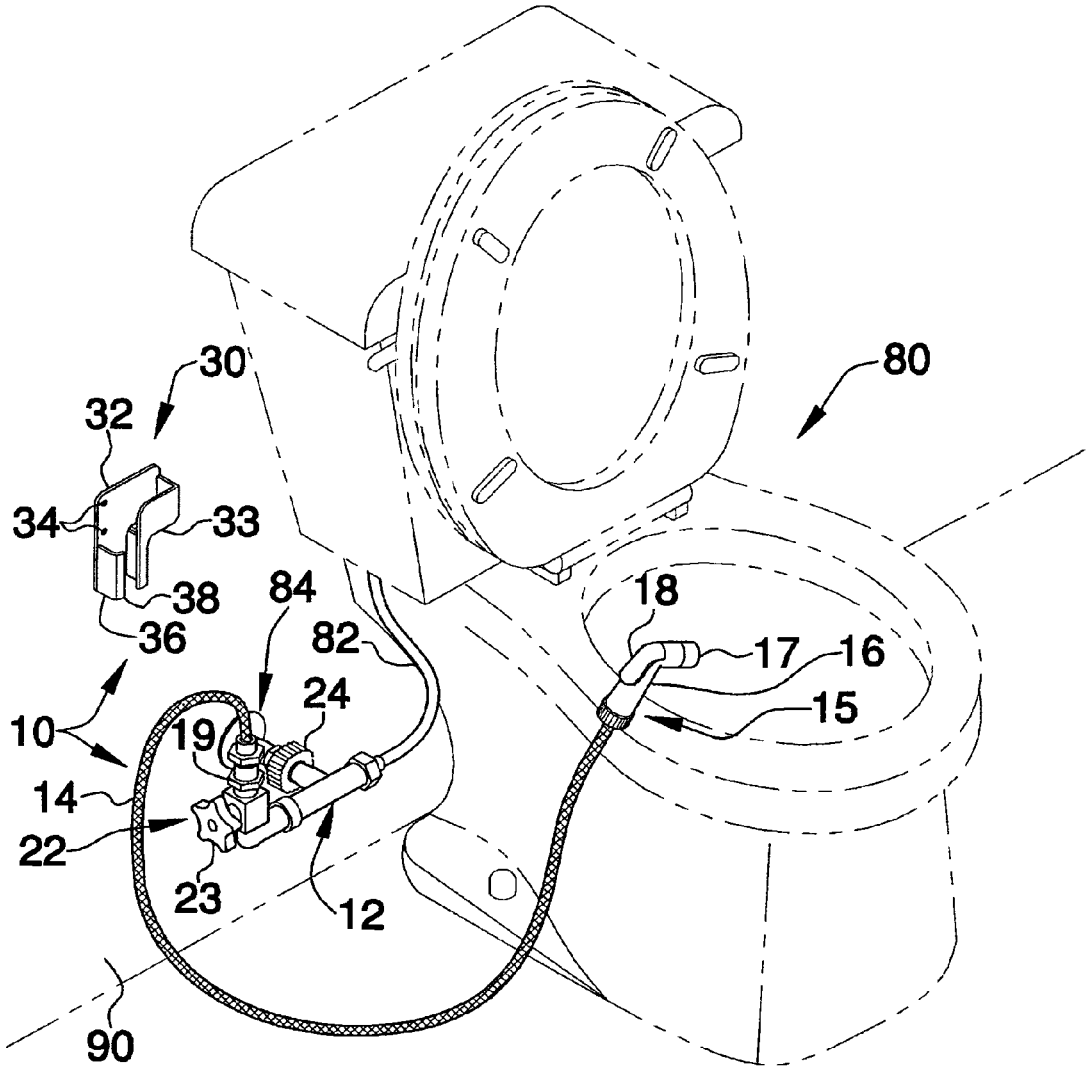
FIG. 1 is a perspective view of the invention installed within a bathroom and accompanying a typical toilet.
Figure 4:
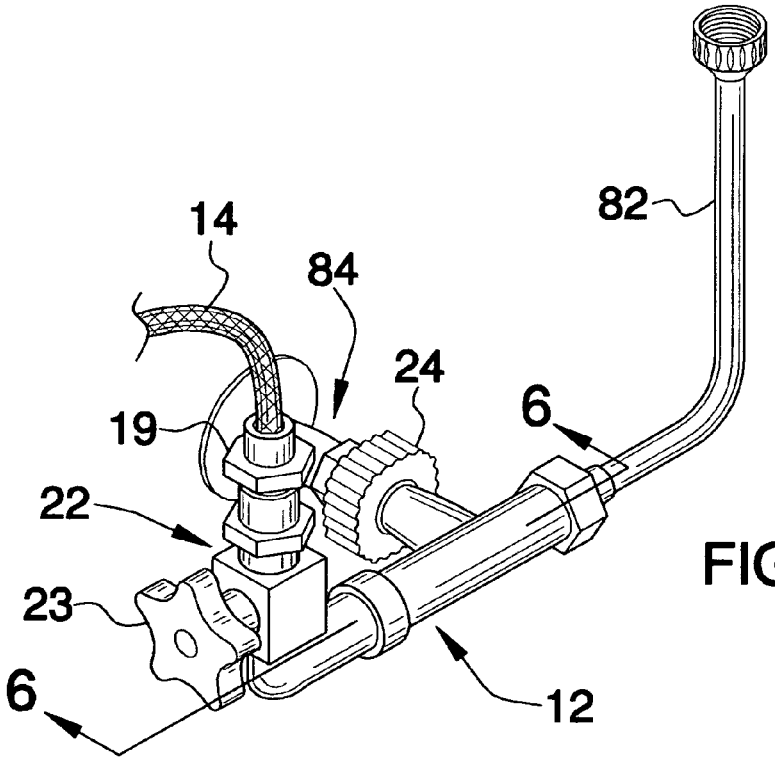
FIG. 4 is a perspective view of the double connect and control valve of the invention.

Referring to FIGS. 1 and 4, the invention 10 comprises a valved double connect 12. The valved double connect 12 is removably attached to an existing water supply 84. The valved double connect 12 employs a knurled knob 24 to connect to the existing water supply 84. The double connect 12, on one end, supplies the existing reservoir supply 82 of the typical toilet 80. The second end of the double connect 12 supplies water to the flex hose 14. The supply to the flex hose 14 is regulated by the control valve 22. The control valve 22 is adjusted by the adjustment knob 23.

The control valve 22 is disposed at a right angle to the body of the double connect 12. The hose connect 19 connects the flex hose 14 to the control valve 22. The flex hose 14 supplies the sprayer 15 of typical design known in the art. The sprayer 15 is temporarily positioned over the toilet 80. The sprayer 15 is further comprised of the sprayer body 16 and the spray head 17. Flow through the spray head 17 is regulated by the trigger 18. The shape of the sprayer 15 is generally that of a pistol. The invention is further comprised of a holster 30 for removably containing the sprayer 15. The holster 30 is generally an inverted L-shape and mounts to a wall 90 within a typical bathroom.

Figure 2:
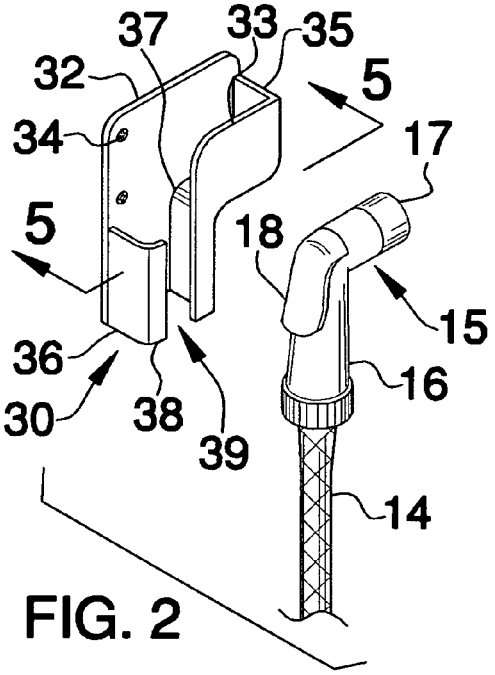
FIG. 2 is a perspective view of the sprayer and the holster for removably holding the sprayer.
Figure 5:
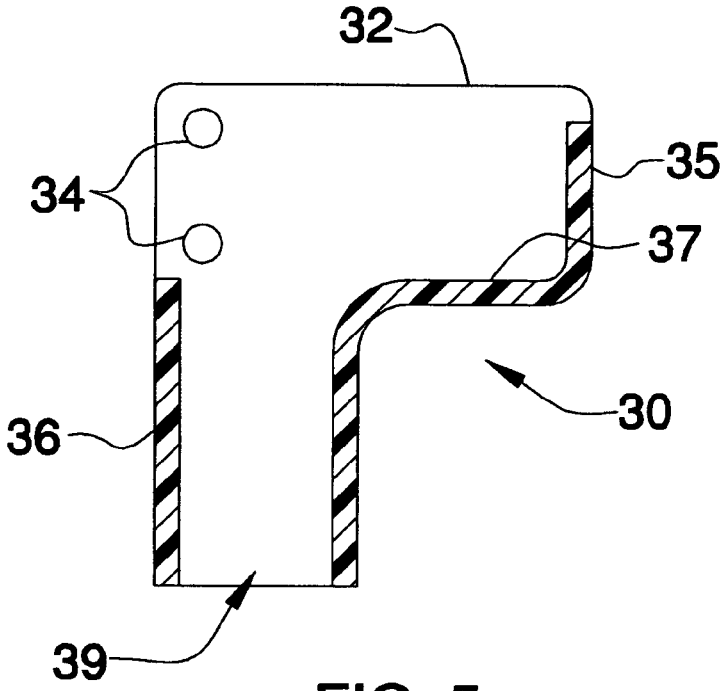
FIG. 5 is a cross sectional vie of the holster of FIG. 2 taken along the line 5—5.

Referring to FIGS. 2 and 5, the holster 30 inverted L-shape comprises back plate 32. The back plate 32 comprises at two mounting holes 34, one hole 34 above the other hole 34. Mounting holes 34 would preferably be aligned with a wall stud (not shown). The sprayer retainer 36 is perpendicularly affixed to the side of the back plate 32. The retainer 36 further comprises a retainer bend 38. The retainer bend 38 is affixed to the retainer 36 at a right angle to the retainer 36. The retainer bend 38 is coplanar to the back plate 32. The spray head rest 37 is perpendicularly affixed to the back plate 32. The spray head rest 37 is of a like but smaller L-shape as the back plate 32. The spray head rest 37 is on a side of the back plate 32 opposite the retainer 36. The spray head rest 37 is perpendicularly affixed to the back plate 32. The keeper 33 is affixed at a right angle to the spray head rest 37. The keeper 33 is coplanar to the back plate 32. The keeper 33 and the retainer bend 38 are at a spaced apart distance on the back plate 32.

The trunk 39 is formed by the spaced apart placement of the sprayer retainer 36 and the spray head rest 37, whereby the sprayer 15 removably and securely rests within the holster 30. The trunk 39 provides for removal of the sprayer 15 from the holster 30. The sprayer 15 is lifted from the rest 37. The flex hose 14 passes out of the trunk 39. The holster 30 prevents the sprayer 15 from falling out and inadvertently spraying water.

Figure 6:
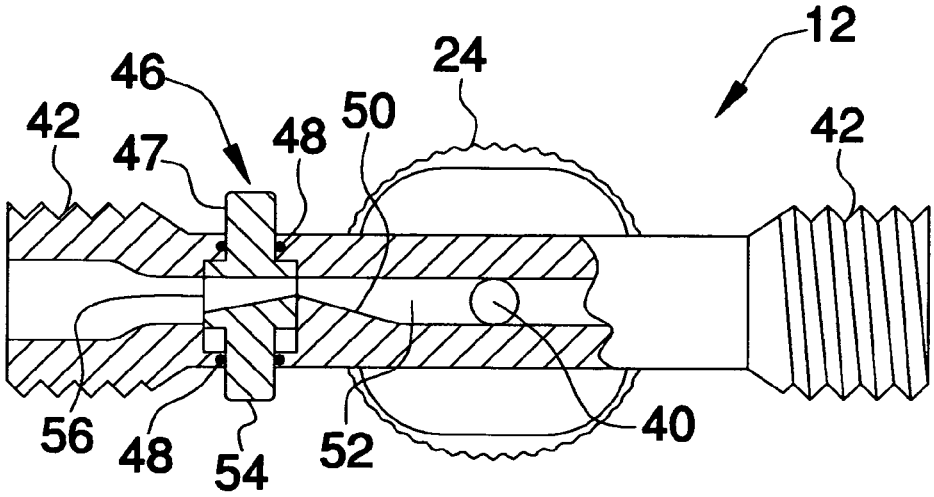
FIG. 6 is a cross sectional view of an alternative example of a double connect of the invention, the view taken along the line 6—6 of FIG. 4.

Referring to FIG. 6, the alternate example of the double connect 12 is comprised of an inlet 40. The inlet 40 is supplied by the existing water supply 84. The bi-directional flow channel 52 is supplied by the inlet 40 at a right angle. The male thread 42 is on one end of the valved double connect 12. The male thread 42 removably receives the existing reservoir supply 82 to the toilet 80 (FIG. 1). The like second male thread 42 is on the opposite end of the double connect 12. The valve ramp 50 is disposed in the flow channel 52. The ramp 50 is disposed between the inlet 40 and the second male thread 42. The push valve 46 is disposed between the inlet 40 and the second male thread 42. The push valve 46 is adjacent to the ramp 50. The push valve 46 comprises a rigid side 47. The rigid side 47 is disposed on one side of the flow channel 52. The piston bore 56 extends across the flow channel 52. The piston bore 56 is in coplanar alignment to the rigid side 47 of the push valve 46. The bore 56 perpendicularly opens to the flow channel 52. The control piston 54 adjustably moves within the bore 56 by adjustment means (not shown). The rigid side 47 and the piston 54 are sealed within the double connect by o-rings 48.

Figure 3:
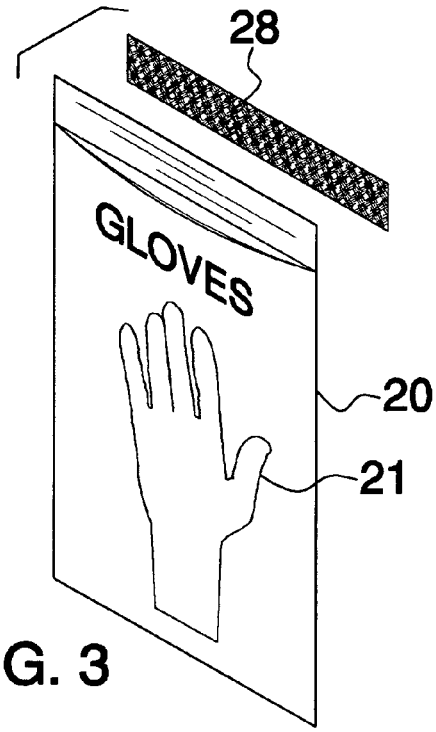
FIG. 3 is a perspective view of the invention's glove bag and adhesive for temporarily holding the glove bag to a surface.

The push valve 46 thereby controls water through the double connect 12. a flexible hose, the flexible hose having two ends, a first end connected to the second male thread of the double connect;

Referring to FIG. 3, the kit 10 further comprises a glove bag 20 holding disposable gloves 21. The glove bag 20 is removably affixed to a wall 90 by a double sided adhesive 28. The gloves 21 are used in operating the sprayer 15 such that any effluent and water does not contaminate a user's hand (not shown).

With respect to the above description then, it is to be realized that the optimum dimensional relationships for the parts of the personal hygiene toilet kit, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A personal hygiene toilet kit, the kit for use in personal cleansing and in cleansing the toilet, the kit comprising:

a valve means, the valve means connected to existing toilet water supply, whereby the existing toilet remains supplied with water;

a flexible hose supplied by the valve means, the flexible hose having two ends, a first end connected to the valve means;

a sprayer means connected to the second end of the flexible hose, the sprayer means comprising:

a sprayer body;

a trigger affixed to the body, the trigger for turning the spray off and on;

a spray head, the spray head dispensing water from the sprayer when triggered;

a holster, the holster for removably containing the sprayer means, the holster further comprising:

a back plate, the back plate generally an inverted L-shape, the back plate for abutment against a mounting surface;

mounting holes for mounting the back plate against the surface;

a sprayer retainer, the retainer perpendicularly affixed to a side of the back plate;

a retainer bend of the retainer, the retainer bend at a right angle to the retainer, the retainer bend coplanar to the back plate;

a spray head rest, the head rest perpendicularly affixed to the back plate, the head rest of a like but smaller L-shape as the back plate, the head rest on a side of the back plate opposite the retainer;

a keeper, the keeper affixed at a right angle to the spray head rest, the keeper coplanar to the back plate, the keeper and the retainer bend at a spaced apart distance;

a trunk formed by the spaced apart placement of the sprayer retainer and the spray head rest, whereby the sprayer removably and securely rests within the holster, the trunk providing for removal of the sprayer from the holster;

a bag of disposable gloves, the gloves for personal use;

means for removably adhering the bag to a surface of the bathroom, whereby the sprayer is used for both personal cleansing and toilet cleansing.

2. The invention in claim 1 wherein the means for removably adhering the bag to a surface is two-way adhesive tape.

3. The invention in claim 2 wherein the trigger of the sprayer further provides graduated flow of water spray.

4. The invention in claim 3 wherein the valve means comprises an adjustment valve, the adjustment valve for controlling water flow to the flexible hose.

5. The invention in claim 4 wherein the adjustment means further comprises an adjustment knob.

6. The invention in claim 5 wherein the valve means comprises:

a double connect;

a knurled knob on the double connect, the knob for connecting the double connect to an existing toilet water supply;

a bi-directional flow from the double connect, one side of the bi-directional flow supplying the toilet, an opposite side of the bi-directional flow supplying the adjustment valve supplying the flexible hose.

7. A personal hygiene toilet kit, the kit for use in personal cleansing and in cleansing the toilet, the kit comprising:

a valved double connect, the valved double connect removably attaching to an existing bathroom water supply, the valved double connect comprising:

a knurled knob connecting to the existing water supply;

an inlet, the inlet supplied by the existing water supply;

a bi-directional flow channel, the flow channel supplied by the inlet at a right angle;

a male thread on one end of the valved double connect, the male thread removably receiving an existing reservoir supply to the toilet;

a like second male thread on an opposite end of the double connect;

a valve ramp in the flow channel, the ramp between the inlet and the second male thread;

a push valve disposed between the inlet and the second male thread, the push valve comprising:

a rigid side, the rigid side disposed on one side of the flow channel;

a piston bore, the bore in coplanar alignment to the rigid side of the push valve, the bore perpendicularly opening to the flow channel;

a control piston, the control piston adjustably moving within the bore, whereby the push valve controls water through the double connect;

a flexible hose, the flexible hose having two ends, a first end connected to the second male thread of the double connect;

a sprayer connected to the second end of the flexible hose, the sprayer comprising:

a sprayer body;

a trigger affixed to the body, the trigger for turning the spray off and on;

a spray head, the spray head dispensing water from the sprayer when triggered;

a holster, the holster for removably containing the sprayer means, the holster further comprising:

a back plate, the back plate generally an inverted L-shape, the back plate for abutment against a mounting surface;

mounting holes for mounting the back plate against the surface;

a sprayer retainer, the retainer perpendicularly affixed to a side of the back plate;

a retainer bend of the retainer, the retainer bend at a right angle to the retainer, the retainer bend coplanar to the back plate;

a spray head rest, the head rest perpendicularly affixed to the back plate, the head rest of a like but smaller L-shape as the back plate, the head rest on a side of the back plate opposite the retainer;

a keeper, the keeper affixed at a right angle to the spray head rest, the keeper coplanar to the back plate, the keeper and the retainer bend at a spaced apart distance;

a trunk formed by the spaced apart placement of the sprayer retainer and the spray head rest, whereby the sprayer removably and securely rests within the holster, the trunk providing for removal of the sprayer from the holster;

a bag of disposable gloves, the gloves for personal use;

means for removably adhering the bag to a surface of the bathroom, whereby the adjustable flow from the sprayer provides for use of the invention for both personal cleansing and for toilet cleansing.

8. The invention in claim 7 wherein the means for removably adhering the bag to a surface is two-way adhesive tape.

9. The invention in claim 8 wherein the trigger of the sprayer further provides graduated flow of water spray.

* * * * *